United States Patent [19]

Mabuchi et al.

[11] 4,391,889

[45] Jul. 5, 1983

[54] ELECTROPHOTOGRAPHIC PHOTOSENSITIVE MEMBER WITH BENZIMIDAZOLE RING CONTAINING HYDRAZONES

[75] Inventors: Minoru Mabuchi, Tokyo; Kiyoshi Sakai, Mitaka; Shozo Ishikawa, Sayama; Yuji Egashira, Hino; Makoto Kitahara, Yokohama, all of Japan

[73] Assignee: Canon Kabushiki Kaisha, Tokyo, Japan

[21] Appl. No.: 323,880

[22] Filed: Nov. 23, 1981

[30] Foreign Application Priority Data

Dec. 13, 1980 [JP] Japan ..... 55-175250

[51] Int. Cl.[3] ..... G03G 5/04

[52] U.S. Cl. ..... 430/59; 430/70; 430/71; 430/78; 430/80

[58] Field of Search ..... 430/59, 78, 80, 58, 430/70, 71, 77; 564/251

[56] References Cited

U.S. PATENT DOCUMENTS

| | | | |
|---|---|---|---|
| 3,775,105 | 11/1973 | Kukla | 430/80 |
| 3,870,516 | 3/1975 | Smith et al. | 252/501 |
| 3,898,084 | 7/1975 | Champ et al. | 260/148 |
| 4,024,125 | 5/1977 | Kuntsmann et al. | 260/157 |
| 4,052,210 | 10/1977 | Hectors | 252/501 |
| 4,150,987 | 4/1979 | Anderson et al. | 430/78 |
| 4,251,613 | 2/1981 | Sasaki et al. | 430/72 |
| 4,251,614 | 2/1981 | Sasaki et al. | 430/79 |
| 4,256,821 | 3/1981 | Enomoto et al. | 430/59 |
| 4,260,672 | 4/1981 | Sasaki et al. | 430/72 |
| 4,268,596 | 5/1981 | Sasaki et al. | 430/72 |
| 4,272,598 | 6/1981 | Sasaki et al. | 430/72 |
| 4,278,747 | 7/1981 | Murayama et al. | 430/58 |
| 4,284,698 | 8/1981 | Kazami et al. | 430/58 |
| 4,293,628 | 10/1981 | Hashimoto | 430/58 |
| 4,297,426 | 10/1981 | Sakai et al. | 430/59 |
| 4,338,388 | 7/1982 | Sakai et al. | 430/58 |

FOREIGN PATENT DOCUMENTS

| | | |
|---|---|---|
| 13172 | 7/1980 | European Pat. Off. . |
| 1370197 | 10/1974 | United Kingdom . |
| 1465141 | 2/1977 | United Kingdom . |
| 1465142 | 2/1977 | United Kingdom . |
| 1490197 | 10/1977 | United Kingdom . |
| 2001769A | 2/1979 | United Kingdom . |
| 2055803A | 3/1981 | United Kingdom . |

*Primary Examiner*—Richard L. Schilling

*Attorney, Agent, or Firm*—Fitzpatrick, Cella, Harper & Scinto

[57] ABSTRACT

An electrophotographic photosensitive member comprises a layer containing at least one member of the hydrazone compounds of the formula:

(1)

where $R_1$, $R_2$ and $R_3$ are selected from the group consisting of substituted or unsubstituted alkyl, substituted or unsubstituted aralkyl, and substituted or unsubstituted aryl, and $R_1$ and $R_2$ can not be simultaneously alkyl; and $R_4$ is substituted or unsubstituted aryl.

17 Claims, No Drawings

ELECTROPHOTOGRAPHIC PHOTOSENSITIVE MEMBER WITH BENZIMIDAZOLE RING CONTAINING HYDRAZONES

BACKGROUND OF THE INVENTION

1. Field of the Invention

This invention relates to a photosensitive member, and more particularly, to a photosensitive member having a photosensitive layer containing a novel organic photoconductive material composed of a hydrazone compound having a benzimidazole ring.

2. Description of the Prior Art

As photoconductive materials used for electrophotosensitive members, a variety of inorganic photoconductive materials such as selenium, cadmium sulfide, and zinc oxide are known. These photoconductive materials have many advantages such as charging to an appropriate voltage in the dark, less dissipation of charge in the dark, rapid dissipation of charge when irradiated with a light, and the like.

On the contrary, these photoconductive materials suffer from various drawbacks. For example, selenium photosensitive members are adversely affected by temperature, humidity, dust, pressure and the like, and crystallization of selenium easily proceeds, in particular, when the ambient temperature exceeds 40° C., the crystallization markedly proceeds and there occur various disadvantages such as lowering of chargeability and formation of white spots in the image. When selenium photosensitive members and cadmium sulfide photosensitive members are used under high humidity for a long time, stable sensitivity and durability can not be obtained.

Zinc oxide photosensitive members require dye sensitizers such as Rose Bengal and the like to be sensitized, but such dye sensitizers are deteriorated by corona charging and faded by irradiation light, and therefore it is not possible produce stable images over a long period of time.

On the contrary, there have been proposed a wide variety of organic photoconductive polymers such as polyvinylcarbazoles and the like. Those organic photoconductive polymers are excellent in film-shapeability and light weight as compared with the above-mentioned inorganic photoconductive materials, but the polymers have not yet been practically used since the film-shapeability is not sufficient for practical purposes and, in addition, the sensitivity, durability and stability under changeable environment are poorer than those of inorganic photoconductive materials.

Low molecular weight organic photoconductive materials are proposed, for example, p-diethylaminobenzaldehyde-(diphenylhydrazone) and 1-phenyl-3-(p-diethylaminostyryl)-5-(p-diethylaminophenyl) pyrazoline are proposed by U.S. Pat. Nos. 4,150,987 and 3,837,851, respectively. When an appropriate binder is selected for such low molecular weight organic photoconductive materials, the film-shapeability can be improved to a great extent which is a big problem in the field or organic photoconductive polymers, but the sensitivity is still insufficient.

SUMMARY OF THE INVENTION

An object of the present invention is to provide a novel electrophotographic photosensitive member free from the above mentioned drawbacks.

Another object of the present invention is to provide a novel organic photoconductive material.

A further object of the present invention is to provide a compound appropriate for a charge transport material used for a layered photosensitive member comprising a charge generation layer and a charge transport layer. .

According to the present invention, there is provided an electrophotographic photosensitive member which comprises a layer containing at least one member of the hydrazone compounds of the formula:

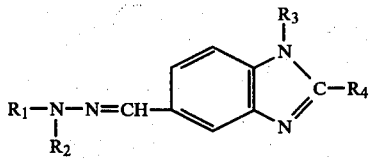

(1)

where $R_1$, $R_2$ and $R_3$ are selected from the group consisting of substituted or unsubstituted alkyl, substituted or unsubstituted aralkyl, and substituted or unsubstituted aryl, and $R_1$ and $R_2$ can not be simultaneously alkyl; and $R_4$ is substituted or unsubstituted aryl.

DESCRIPTION OF THE PREFERRED EMBODIMENTS

The electrophotographic photosensitive member of the present invention is provided with a layer containing at least one of the hydrazone compounds having a benzimidazole ring of the formula (1):

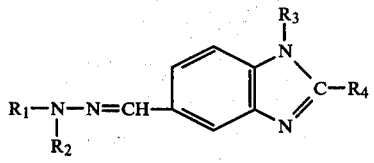

(1)

In the above formula, $R_1$, $R_2$ and $R_3$ are selected from the group consisting of straight chain or branched alkyl such as methyl, ethyl, propyl, butyl, amyl, hexyl, octyl and the like, aralkyl such as benzyl, phenethyl, naphthylmethyl and the like, and aryl such as phenyl, naphthyl, anthryl, pyrenyl, fluorenyl, and the like. These alkyl, aralkyl and aryl may be substituted by alkoxy such as methoxy, ethoxy, propoxy, butoxy and the like, dialkylamino such as dimethylamino, diethylamino, dipropylamino, dibutylamino and the like, diaralkylamino such as dibenzylamino, diphenethylamino and the like, diarylamino such as diphenylamino, ditolylamino, dixylylamino and the like, and halogen such as chlorine, bromine, iodine and the like.

The aralkyl and aryl may be substituted by alkyl such as methyl, ethyl, propyl, butyl and the like. However, $R_1$ and $R_2$ can not be simultaneously alkyl.

$R_4$ is aryl such as phenyl, naphthyl, anthryl, pyrenyl, fluorenyl and the like, and substituted aryl. The substituent to aryl may be alkyl such methyl, ethyl, propyl, butyl and the like, alkoxy such as methoxy, ethoxy, propoxy, butoxy and the like, dialkylamino such as dimethylamino, diethylamino, dipropylamino, dibutylamino and the like, diaralkylamino such as dibenzylamino, diphenethylamino and the like, diarylamino such as diphenylamino, ditolylamino, dixylylamino and the like, and halogen such as chlorine, bromine, iodine and the like.

Examples of the hydrazone compounds having a benzimidazole ring of the formula (1) above are shown below.
EXAMPLES OF COMPOUND
No. 1
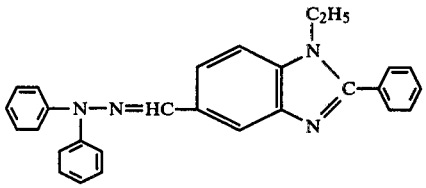
No. 2
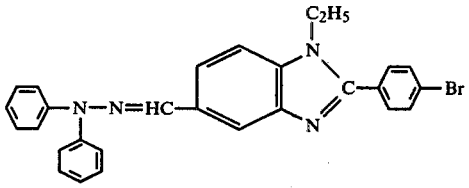
No. 3
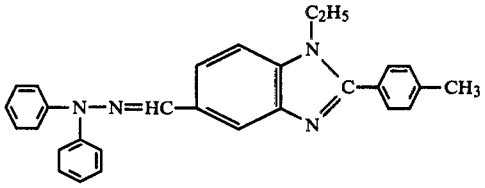
No. 4
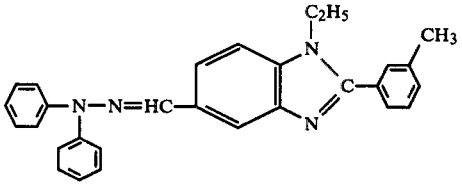
No. 5
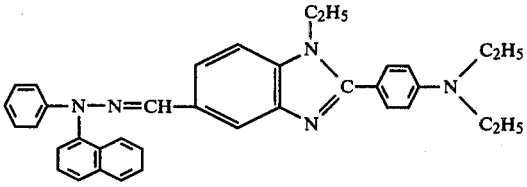
No. 6
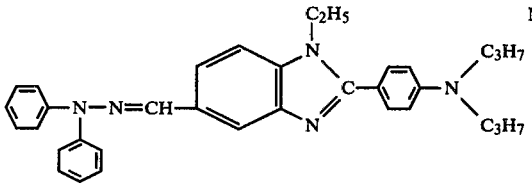
No. 7
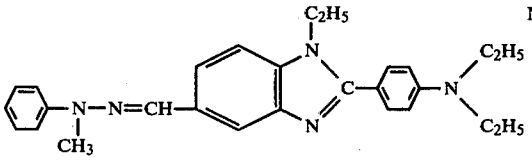
-continued
No. 8
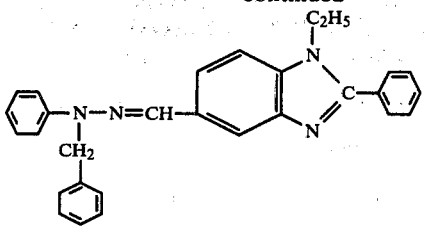
No. 9
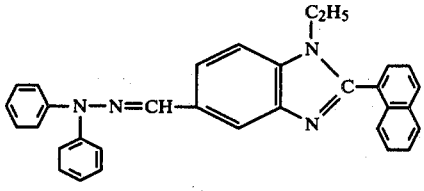
No. 10
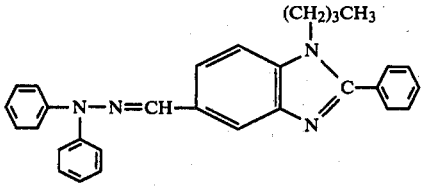
No. 11
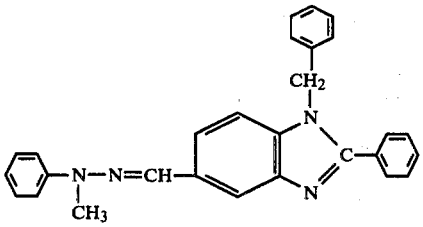
No. 12
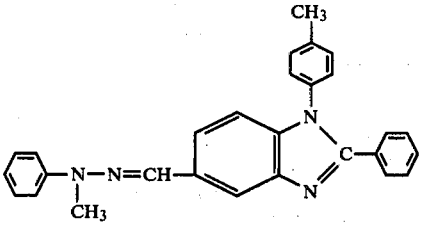
No. 13
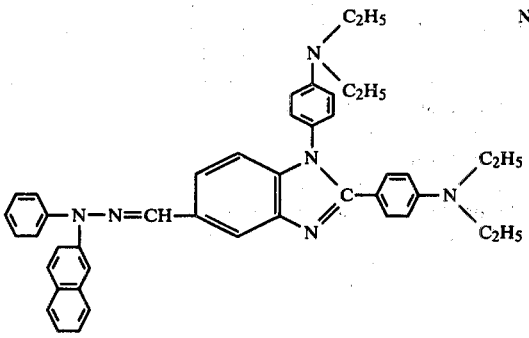
No. 14
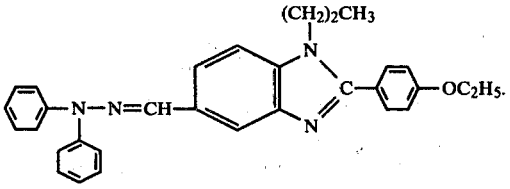

These compounds may be used alone or in combination.

The hydrazone compound of formula (1) may be produced by a conventional process from a hydrazine of the formula (2),

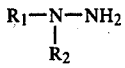

(2)

where $R_1$ and $R_2$ are as defined above or a mineral acid salt thereof and an aldehyde of the formula (3),

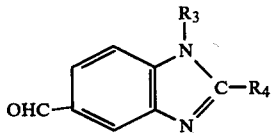

(3)

where $R_3$ and $R_4$ are as defined above. The above mentioned hydrazine and aldehyde are condensed in a solvent such as alcohols, dimethylformamide (DMF), dimethylsufloxide (DMSO) and the like, if desired, a small amount of an acid such as glacial acetic acid and inorganic acids as a condensation agent.

An example of a method for preparing a representative hydrazone compound is shown below.

PREPARATION EXAMPLE 1 (COMPOUND NO. 1 ABOVE)

27.7 g (0.14 mol.) of a nitroso compound of the formula

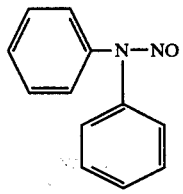

was dissolved in 230 ml. of acetic acid, cooled to 10° C., reduced by adding 87.5 g (1.14 mol.) of zinc dust little by little, filtered, and water was added thereto to isolate the resulting hydrazine compound.

Then the hydrazine compound was dissolved in 110 ml. of ethanol, and 35.0 g (0.14 mol.) of an aldelyde compound of the formula

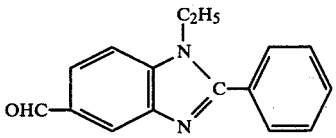

and the mixture was stirred for 30 minutes. Then, the reaction mixture was poured into water to obtain a yellow precipitate. The precipitate was recrystallized from methyl ethyl ketone. As a result, 15 g. of yellow crystal was obtained in a yield of 25.8% based on the nitroso compound.

Analysis for $C_{28}H_{24}N_4$: Calc.: C, 80,77%; H, 5.77%; N, 13.46%. Found: C, 80,72%, H, 5.81%; N,13.47%.

The hydrazone compound of the formula (1) above may be used for any electrophotographic photosensitive members where an organic photoconductive material can be used. Preferable electrophotographic photosensitive members are:

(i) electrophotographic photosensitive members where a charge transfer complex formed by combining an electron donating substance and an electron accepting substance is used;

(ii) electrophotographic photosensitive members where an organic photoconductive member sensitized with a dye is used;

(iii) electrophotographic photosensitive members where a hole matrix containing dispersed pigment is used;

(iv) electrophotographic photosensitive members where a charge generation layer and a charge transport layer are used, (v) electrophotographic photosensitive members where co-crystalline complex composed of a dye and a resinous material and an organic photoconductor are used as main components; and (vi) electrophotographic photosensitive members where a charge transfer complex containing an added organic or inorganic charge generation material is used.

Among them, (iii)–(vi) are more preferable.

In particular, when the photosensitive members of (iv) are employed, that is, a hydrazone compound of Formula (1) is used as a material for the charge transport layer of said photosensitive members comprising two layers having different functions from each other, the sensitivity of the photosensitive members is high and the remaining voltage is low. In this case, lowering of sensitivity due to repeated use and increase in remaining voltage can be suppressed to a negligible small degree.

The photosensitive members of type (iv) are explained in detail below. This type of photosensitive member comprises a conductive layer, a charge generation layer and a charge transport layer. The charge generation layer may be on or under the charge transport layer. In the case of photosensitive members used repeatedly, it is preferable sometimes from the viewpoint of physical strength or chargeability that these layers are laminated in the sequent order of a conductive layer, a charge generation and a charge transport layer. An adhesive layer may be disposed between the conductive layer and the charge generation layer so as to enhance the adhesion.

As the conductive layer, any conventional conductive layers may be used.

As the adhesive, there may be used various conventional polymeric binders such as casein, hydroxypropylcellulose and the like. The thickness of the adhesive layer is usually 0.1–5$\mu$, preferably 0.5–3$\mu$.

As materials for the charge generation layer, there may be used any materials capable of absorbing light and generating charge carriers at a high efficiency.

Preferable materials for the charge generation layer are inorganic materials such as selenium, selenium.tellurium, selenium.arsenic, cadmium sulfide, amorphous silicon and the like, and organic materials such as pyrylium dyes, thiopyrylium dyes, triarylmethane dyes, thiazine dyes, cyanine dyes, phthalocyanine pigments, perylene pigments, indigo pigments, thioindigo pigments, quinacridone pigment, squaric acid pigments, azo pigments, polycyclic quinone pigments and the like.

Thickness of the charge generation layer is usually less than 5$\mu$, preferably 0.05–3$\mu$.

The charge generation layer may be produced by various known means such as vacuum evaporation deposition, sputtering, glow discharge, coating and the like, depending upon the kind of the used material. As the coating procedure, the material for charge generation may be made into a layer without using any binder, may be coated in a form of a resin dispersion liquid, or in a form of a uniform solution together with a binder.

When the charge generation layer is formed by coating a resin dispersion liquid of a charge generation material or a solution of a charge generation material, a large amount of binders adversely affect the sensitivity so that the amount of binders contained in the charge generation layer is usually less than 80%, preferably less than 40%. As a binder used for the charge generation layer, there may be mentioned various conventional resinous materials such as polyvinylbutyral and the like.

A charge transport layer is disposed on the charge generation layer as formed above. Thickness of the charge transport layer is usually 5–30μ, preferably 8–20μ.

Representative charge generation materials are as shown below.

Charge Generation Materials

| | |
|---|---|
| Amorphous silicon | (1) |
| Selenium-tellurium | (2) |
| Selenium-arsenic | (3) |
| Cadmium sulfide | (4) |

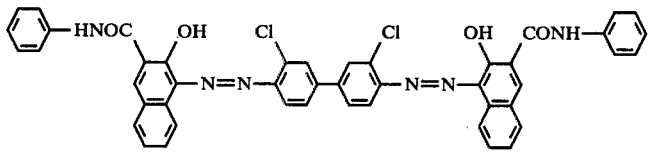

(5)

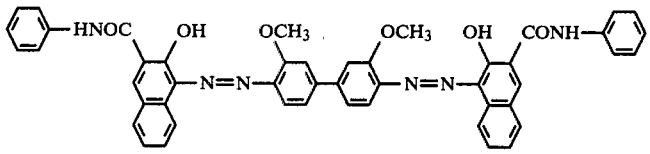

(6)

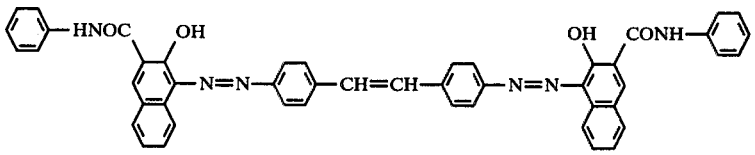

(7)

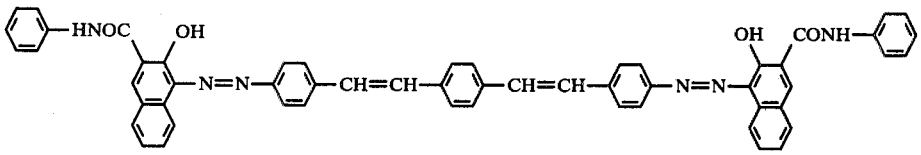

(8)

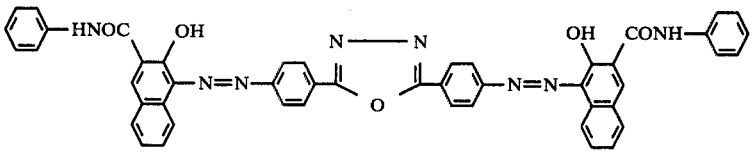

(9)

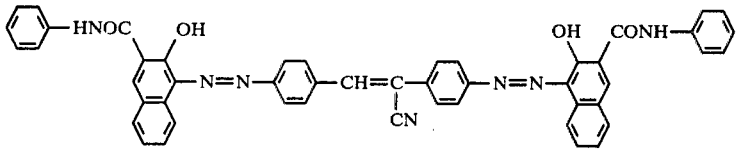

(10)

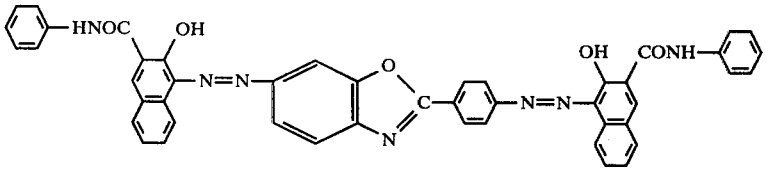

(11)

-continued
(12)
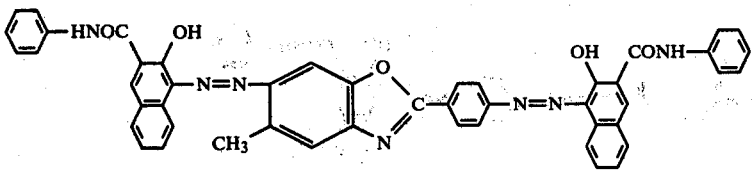
(13)
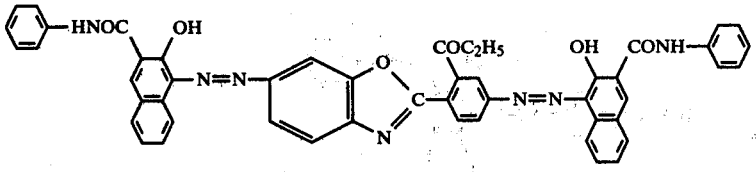
(14)
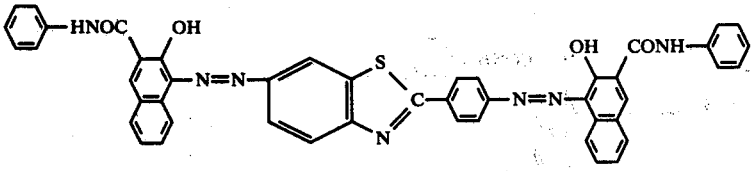
(15)
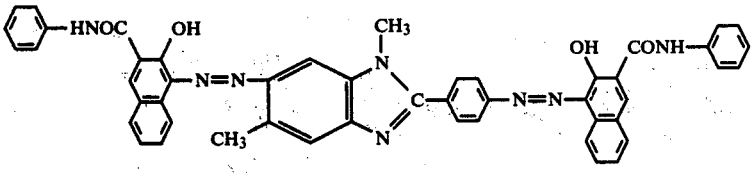
(16)
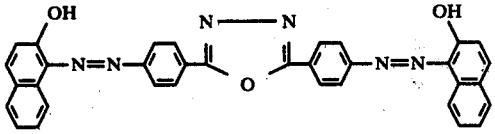
(17)
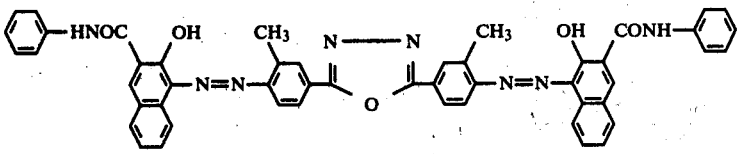
(18)
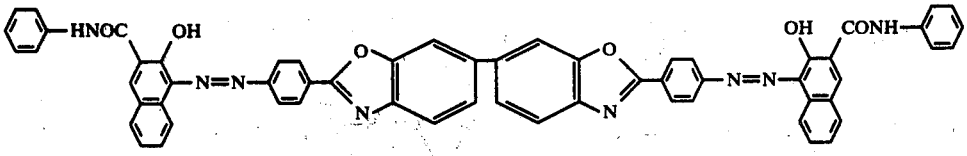
(19)
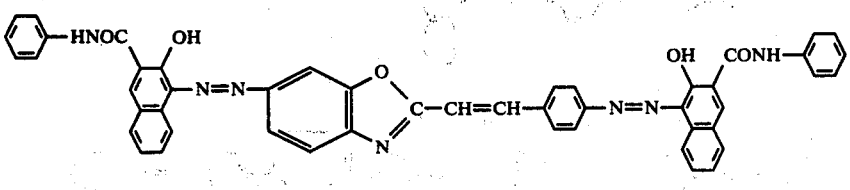
(20)
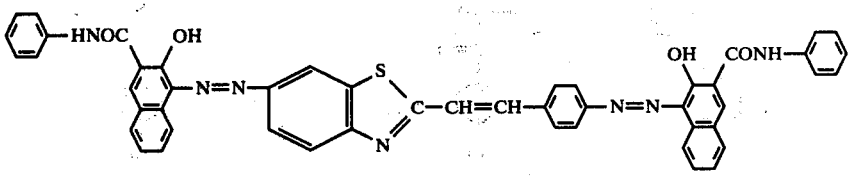

-continued
(21)
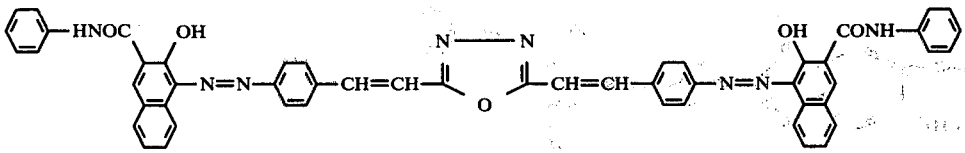
(22)
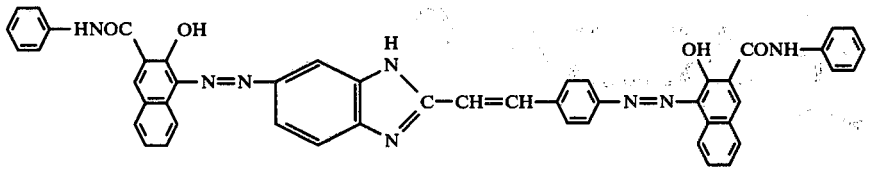
(23)
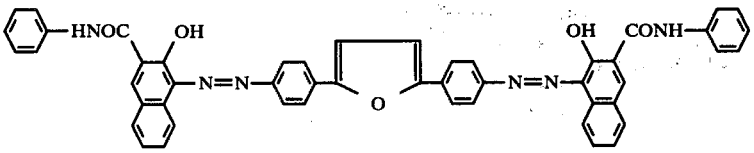
(24)
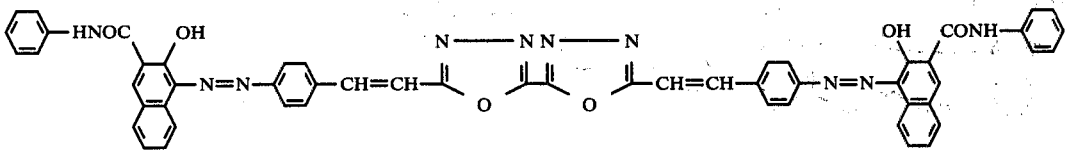
(25)
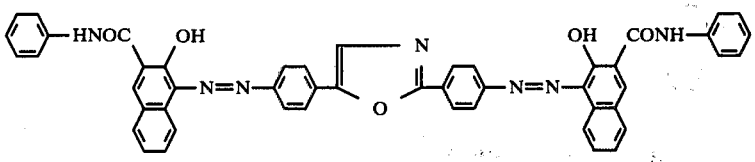
(26)
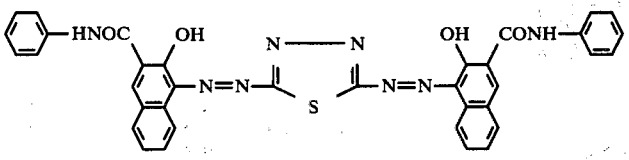
(27)
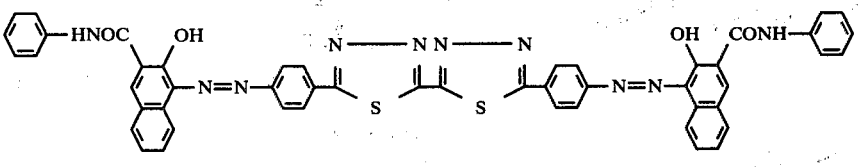
(28)
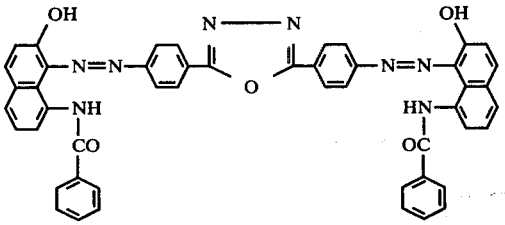
(29)
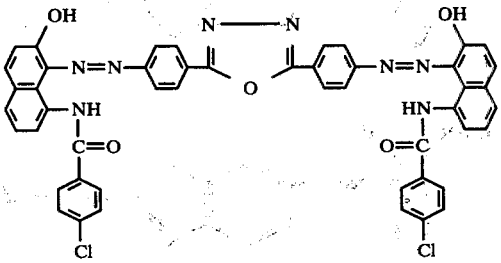

-continued
(30)
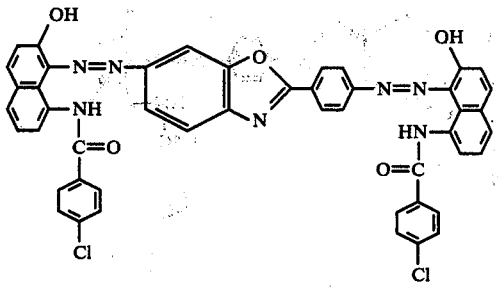
(31)
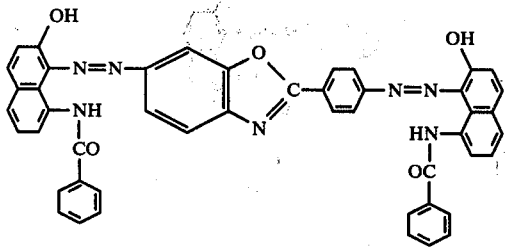
(32)
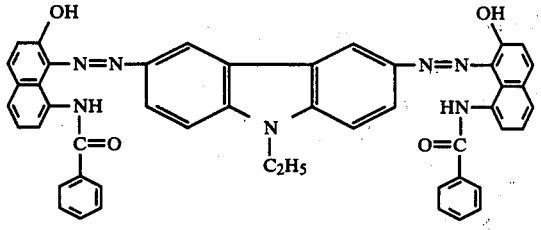
(33)
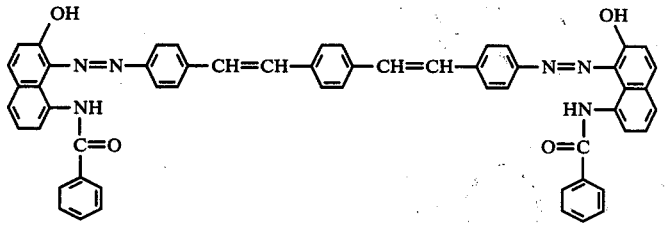
(34)
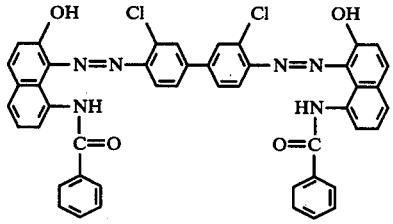
(35)
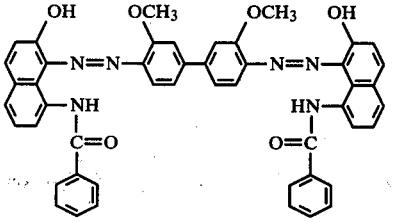
(36)
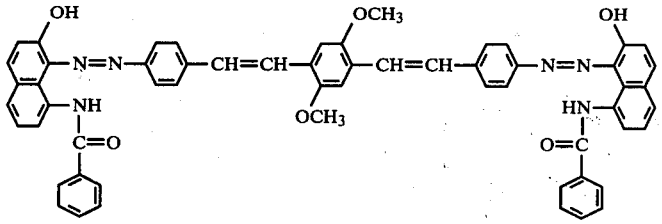
(37)
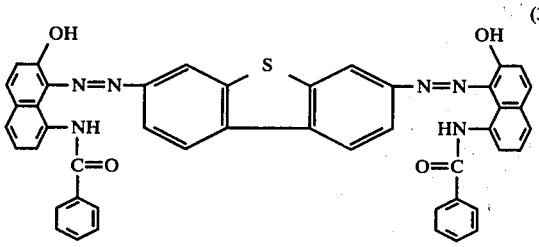
(38)
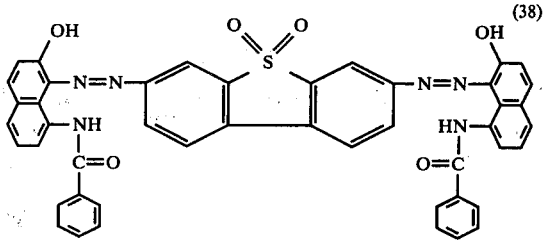

-continued
(39)
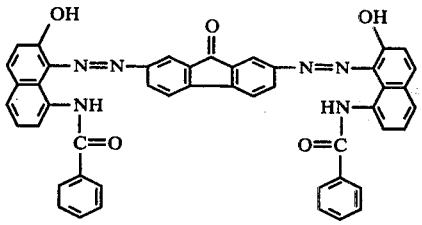
(40)
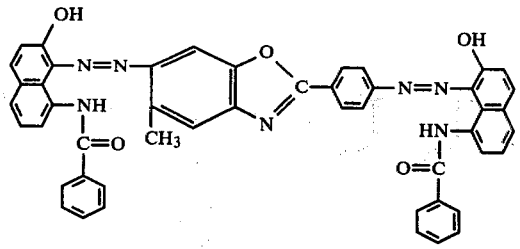
(41)
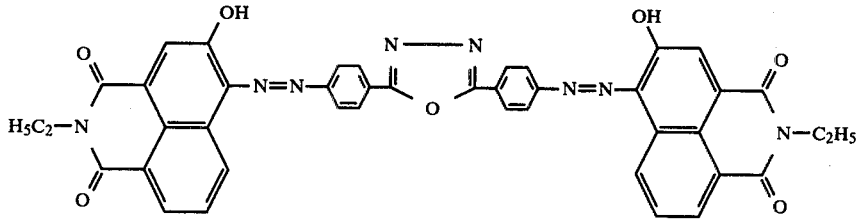
(42)
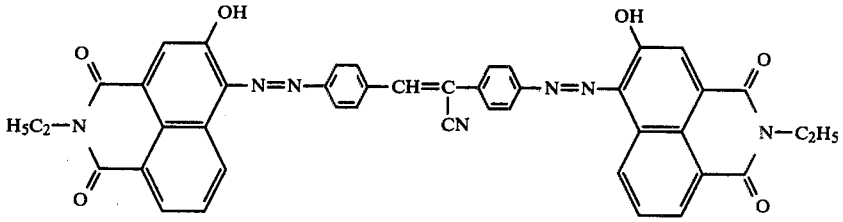
(43)
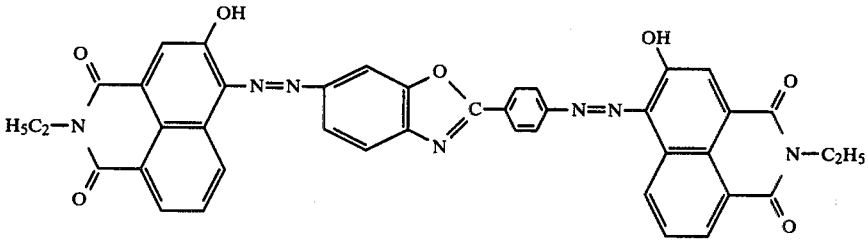
(44)
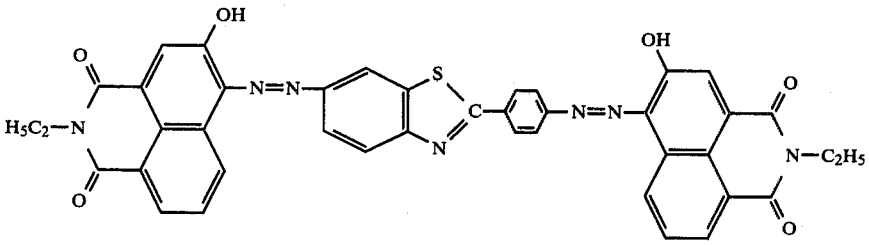
(45)
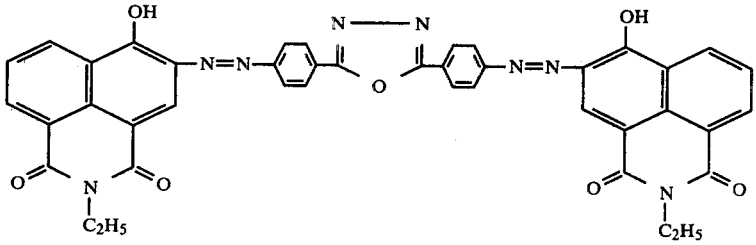
(46)
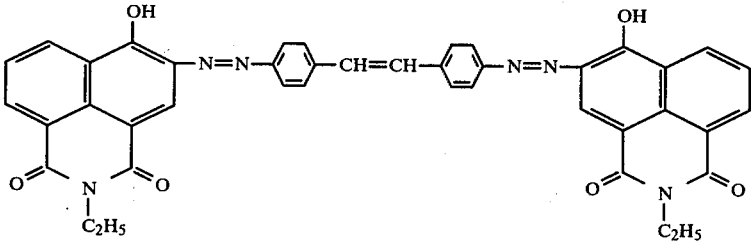

-continued

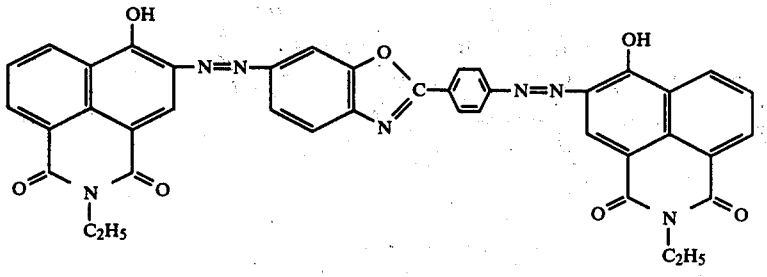

(47)

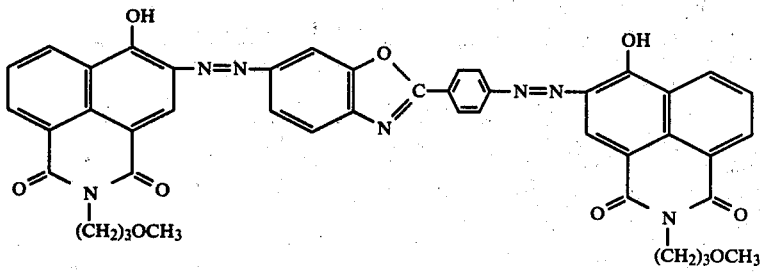

(48)

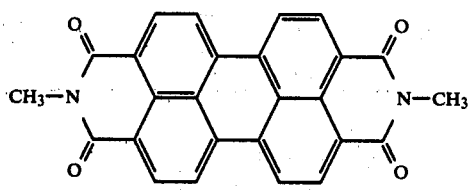

(49)

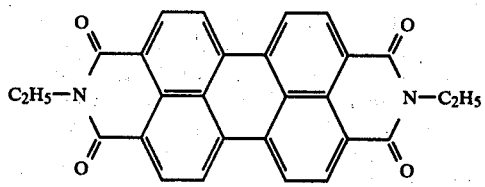

(50)

| | |
|---|---|
| Methine dyes derived from squaric acid | (51) |
| Indigo dye (C.I. No. 78000) | (52) |
| Thioindigo dye (C.I. No. 78800) | (53) |
| $\beta$-type copper phthalocyanine. | (54) |

The hydrazone compound used in the present invention does not possess film shapeability, and therefore, the hydrazone compound and an appropriate resinous binder are dissolved in a suitable organic solvent and the resulting solution is applied and dried according to a conventional method to form a charge transport layer.

As the binder, there may be used various conventional binders such as acrylic resins, polycarbonate resins, polyester resins and the like. It is also possible to use a photoconductive polymer having a charge transport ability such as poly-N-vinylcarbazole and the like.

The hydrazone compound used in the present invention is a type of hole transport. Therefore, in case that a photosensitive member composed of a conductive layer, a charge generation layer and a charge transport layer layered in the above mentioned order is used, the surface of the charge transport layer is required to be negatively charged. When the photosensitive member is thus charged and then exposed, holes formed at the exposed portion of the charge generation layer are injected into the charge transport layer and then reaches the surface to neutralize the negative charge. As a result, the surface voltage is decayed and electrostatic contrast is produced between the exposed and the unexposed portions. The resulting electrostatic images may be visualized by using various developing methods.

Photosensitive members other than those of type (iv) above are described in detail in many literatures and patents.

The electrophotographic photosensitive member according to the present invention may be used for various techniques utilizing electrophotography such as laser printers, CRT printers, electrophotographic printing master system and the like as well as electrophotographic copying machines.

The following examples are given for illustrating the present invention, but not for limiting the scope of the present invention.

EXAMPLE 1

An aqueous ammonium solution of casein (11.2 g casein, 1 g 28% aqueous ammonium and 222 ml. water) was applied to an aluminum plate by means of a Meyer bar and dried to form an adhesive layer of 1.0 g/m$^2$. 5 g of a disazo pigment of the formula,

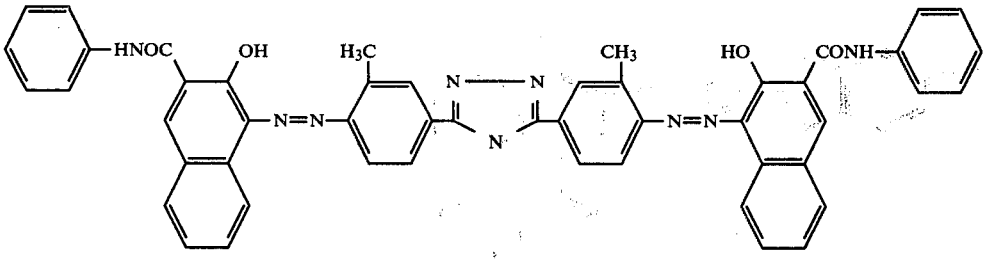

and a solution of 2 g of vinyl butyral resin (Degree of butyral conversion: 63 mol.%) in 95 ml. of ethanol were mixed and dispersed. The resulting dispersion was applied to the above mentioned adhesive layer to form a charge generation layer of 0.2 g/m$^2$ after drying.

5 g of the above mentioned hydrazone compound No. 1 and 5 g of poly-4,4'-dihydroxydiphenyl-2,2-propane carbonate (viscosity-average molecular weight: 30,000) were dissolved in 150 ml. of dichloromethane, and the resulting solution was applied to the charge generation layer and dried to form a charge transport layer of 10 g/m$^2$.

The resulting electrophotographic photosensitive member was tested by using an electrostatic copying paper tester, Model SP-428 (manufactured by Kawaguchi Denki, K.K., Japan), that is, the photosensitive member was subjected to corona charging at ⊖5 KV according to a static method, kept in a dark place for 10 sec., exposed at an illuminance of 5 lux, and the charging characteristics were examined. The charging characteristics were as shown below. The initial voltage Vo(v), the voltage retaining rate Rv(%), and the half decay exposure E½(lux.sec) were, ⊖560 V, 94% and 7.6 lux.sec, respectively.

EXAMPLES 2–11

A pigment of the formula,

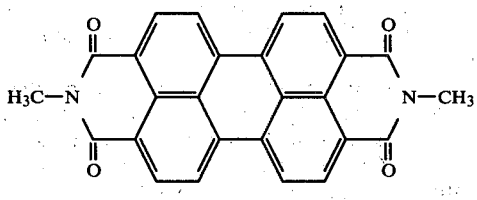

was vapor-deposited on an aluminum plate to form a charge generation layer of 0.15μ thick.

Then a solution prepared by dissolving 5 g of a polyester resin (tradename, "Vylon 200", supplied by Toyo Boseki K.K.) and 5 g of one of the above mentioned Compound Nos. 2–14 in 150 ml. of dichloromethane was applied to the surface of the charge generation layer, and dried to form a charge transport layer of 11 g/m$^2$.

The resulting electrophotographic photosensitive member was tested with respect to the charging characteristics in a way similar to Example 1 above. The results are as shown below.

TABLE

| Example No. | Compound No. | Vo(⊖v) | Rv(%) | E ½(lux.sec) |
|---|---|---|---|---|
| | (Charging Characteristics) | | | |
| 2 | 2 | 540 | 89 | 8.3 |

TABLE-continued

| Example No. | Compound No. | Vo(⊖v) | Rv(%) | E ½(lux.sec) |
|---|---|---|---|---|
| | (Charging Characteristics) | | | |
| 3 | 3 | 560 | 90 | 8.0 |
| 4 | 4 | 530 | 88 | 8.2 |
| 5 | 5 | 510 | 90 | 7.3 |
| 6 | 6 | 550 | 92 | 7.0 |
| 7 | 7 | 560 | 93 | 12.3 |
| 8 | 8 | 540 | 90 | 14.9 |
| 9 | 9 | 510 | 89 | 7.8 |
| 10 | 10 | 540 | 92 | 8.6 |
| 11 | 11 | 530 | 94 | 10.3 |
| 12 | 12 | 560 | 88 | 7.9 |
| 13 | 13 | 550 | 92 | 7.0 |
| 14 | 14 | 590 | 94 | 9.4 |

EXAMPLE 15

5 g of the above mentioned Compound No. 1 and 5 g of a copolymer ester of bisphenol A and terephthalic acid-isophthalic acid (Molar ratio of terephthalic acid to isophthalic acid being 1:1) were dissolved in 150 ml. of dichloromethane, and 1.0 g of β-type copper phthalocyanine was added to the resulting solution and dispersed therein. The resulting dispersion was applied to a casein layer on an aluminum plate as prepared according to Example 1 by using a Meyer bar and dried to form a coating of 12 g/m$^2$.

The resulting photosensitive member was tested with respect to charging characteristics in a manner similar to Example 1 except that charging polarity was ⊕. The results are as shown below.

Vo: ⊕530 v;
Rv: 88%;
E ½: 20 lux·sec.

EXAMPLE 16

On an aluminum plate was vacuum vapor deposited a selenium-tellurium (10% tellurium) to form a charge generation layer of 0.8μ thick. Then, a charge transport layer was produced following the procedure of Example 2 to produce a photosensitive member, which was tested in a manner similar to Example 1. The test result is as shown below.

Vo: ⊖580 v;
Rv: 88%;
E ½: 6.6 lux·sec.

EXAMPLE 17

A molybdenum plate (substrate) of 0.2 mm thick with a cleaned surface was fixed to a predetermined position in a glow discharge vapor deposition vessel and the vessel was evacuated to about $5\times10^{-6}$ torr., and then the input voltage of power supplied to the heater was elevated to keep the molybdenum substrate temperature stably at 150° C. Then, hydrogen gas and a silane gas (15% by volume based on the hydrogen gas) were introduced into the vessel, and the gas flow rate and the main valve of the vapor deposition vessel were controlled to set the pressure stably at 0.5 torr.

Then, a high frequency power of 5 MHz was applied to the induction coil to generate a glow discharge in the coil and the input power was set to 30 W. Under the above-mentioned conditions an amorphous silicon film was grown on the substrate and said conditions were kept until the film thickness became 2μ, and then the glow discharge was ceased. And then the heater and the high frequency power source were switched off and after the substrate temperature reached 100° C., outflow valves for hydrogen gas and silane gas were closed, and the pressure in the vessel was once brought to a value lower than $10^{-5}$ torr followed by returning to atmospheric pressure, and then the substrate was taken out.

On the resulting amorphous silicon layer was formed a charge transport layer in a manner similar to Example 10 above.

The photosensitive member thus produced was disposed in a charging and exposing experimenting device, subjected to corona charging at ⊖6 KV and then, immediately imagewise exposed. The imagewise exposure was made by projecting a light image through a transmission type of test chart using a tungsten lamp. Immediately after the imagewise exposure, development was carried out by cascade with a positively chargeable developer (comprising toner and carrier) to produce toner images of good quality.

EXAMPLE 18

An aqueous solution of hydroxypropyl cellulose was applied to an aluminum plate and dried to form an adhesive layer of 0.6 g/m². 5 g of poly-N-vinylcarbazole, 5 g of the Compound No. 5 and 0.1 g of 2,4,7-trinitrofluorenone were dissolved in 150 ml of dichloromethane, and 1.0 g of the disazo pigment as used in Example 1 was added to the resulting solution and dispersed therein. The resulting dispersion was applied to the above mentioned adhesive layer and dried to form a photosensitive layer of 11 g/m².

The photosensitive member thus produced was tested as to charging in a manner similar to Example 1 except that the charging polarity was ⊕. The result is as shown below.

Vo: ⊕500 v;
Rv: 89%;
E ½: 17.2 lux·sec.

What we claim is:

1. An electrophotographic photosensitive member which comprises an electrically conductive layer and a layer containing at least one member of the hydrazone compounds of the formula:

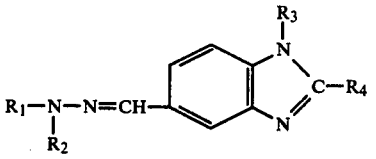

where $R_1$, $R_2$ and $R_3$ are selected from the group consisting of substituted or unsubstituted alkyl, substituted or unsubstituted aralkyl, and substituted or unsubstituted aryl, and $R_1$ and $R_2$ can not be simultaneously alkyl; and $R_4$ is substituted or unsubstituted aryl and a binder.

2. An electrophotographic photosensitive member according to claim 1 in which there are a layer containing the hydrazone compound and a charge generation layer.

3. An electrophotographic photosensitive member according to claim 2 in which the layer containing the hydrazone compound is a charge transport layer capable of transporting holes formed in the charge generation layer.

4. An electrophotographic photosensitive member according to claim 3 in which the charge transport layer is formed on the charge generation layer.

5. An electrophotographic photosensitive member according to claim 4 in which an adhesive layer is an intermediate between the charge generation layer and the conductive layer.

6. An electrophotographic photosensitive member according to claim 5 in which the adhesive layer contains a polymer selected from the group consisting of casein and hydroxypropyl cellulose.

7. An electrophotographic photosensitive member according to claim 1 in which the binder is a resin selected from the group consisting of acrylic resins, polycarbonate resins and polyester resins.

8. An electrophotographic photosensitive member according to claim 2 in which the charge generation layer comprises a member selected from the group consisting of cadmium sulfide, pyrylium dyes, thiopyrylium dyes, triarylmethane dyes, thiazine dyes, cyanine dyes, phthalocyanine pigments, perylene pigments, indigo pigments, thioindigo pigments, quinacridone pigments, squaric acid pigments, azo pigments and polycyclic quinone pigments, and a binder.

9. An electrophotographic photosensitive member according to claim 7 in which the charge generation layer is composed of at least a disazo dye and a binder.

10. An electrophotographic photosensitive member according to claim 2 in which the charge generation layer is composed of a film of amorphous silicon formed by a glow discharge.

11. An electrophotographic photosensitive member according to claim 2 in which the charge generation layer is composed of a vapor-deposited film of a perylene pigment.

12. An electrophotographic photosensitive member according to claim 2 in which the charge generation layer is composed of a vapor-deposited film of selenium-tellurium.

13. An electrophotographic photosensitive member according to claim 1 in which the layer contains the hydrazone compound and a charge generation material and a binder.

14. An electrophotographic photosensitive member according to claim 13 in which the charge generation material is a member selected from the group consisting of cadmium sulfide, pyrylium dyes, thiopyrylium dyes, triarylmethane dyes, thiazine dyes, cyanine dyes, phthalocyanine pigments, perylene pigments, indigo pigments, thioindigo pigments, quinacridone pigments, squaric acid pigments, azo pigments and polycyclic quinone pigments.

15. An electrophotographic photosensitive member according to claim 1 in which the layer contains the hydrazone compound, a charge generation material and a photoconductive polymer.

16. An electrophotographic photosensitive member according to claim 15 in which the charge generation material is composed of a member selected from the group consisting of cadmium sulfide, pyrylium dyes, thiopyrylium dyes, triarylmethane dyes, thiazine dyes, cyanine dyes, phthalocyanine pigments, perylene pigments, indigo pigments, thioindigo pigments, quinacridone pigments, squaric acid pigments, azo pigments and polycyclic quinone pigments.

17. An electrophotographic photosensitive member according to claim 15 in which the photoconductive polymer is poly-N-vinylcarbazole.

* * * * *

UNITED STATES PATENT AND TRADEMARK OFFICE

CERTIFICATE OF CORRECTION

PATENT NO. : 4,391,889

DATED : July 5, 1983

INVENTOR(S) : Minoru Mabuchi, et al

It is certified that error appears in the above-identified patent and that said Letters Patent is hereby corrected as shown below:

Col. 1, line 39, after "possible" insert --to--.
Col. 1, line 51, "environment" should be --environments--.
Col. 1, line 62, "or" should be --of--.
Col. 5, line 23, "dimethylsufloxide" to --dimethylsulfoxide--.
Col. 5, line 49, "aldelyde" should be --aldehyde--.

Col. 6, line 16, after "where" insert --a--.
Col. 6, lines 56 and 57, "selenium.tellurium" should be --selenium-tellurium--.
Col. 6, line 58, "selenium.arsenic" should be --selenium-arsenic--
Col. 6, line 63, "pigment" should be --pigments--.
Col. 22, line 35, "polycryclic" should be --polycyclic--.
Col. 22, line 63, "polycryclic" should be --polycyclic--.
Col. 24, line 2, "polycryclic" should be --polycyclic--.

Signed and Sealed this

Twenty-third Day of October 1984

[SEAL]

*Attest:*

GERALD J. MOSSINGHOFF

*Attesting Officer*

*Commissioner of Patents and Trademarks*